US009157236B2

(12) United States Patent
Jenkins

(10) Patent No.: US 9,157,236 B2
(45) Date of Patent: Oct. 13, 2015

(54) WEATHER RESISTANT SHINGLE SYSTEM

(71) Applicant: Robert L. Jenkins, Honey Brook, PA (US)

(72) Inventor: Robert L. Jenkins, Honey Brook, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 14/302,781

(22) Filed: Jun. 12, 2014

(65) Prior Publication Data

US 2014/0283474 A1 Sep. 25, 2014

Related U.S. Application Data

(60) Continuation of application No. 13/740,347, filed on Jan. 14, 2013, now abandoned, which is a division of application No. 12/560,724, filed on Sep. 16, 2009, now Pat. No. 8,365,493.

(51) Int. Cl.

| | |
|---|---|
| ***E04D 1/34*** | (2006.01) |
| ***E04D 1/26*** | (2006.01) |
| ***E04D 1/22*** | (2006.01) |
| ***E04D 1/00*** | (2006.01) |

(52) U.S. Cl.

CPC .. *E04D 1/34* (2013.01); *E04D 1/00* (2013.01); *E04D 1/22* (2013.01); *E04D 1/26* (2013.01); *E04D 2001/005* (2013.01); *E04D 2001/3408* (2013.01); *E04D 2001/3435* (2013.01)

(58) Field of Classification Search

CPC ..... E04D 1/20; E04D 1/26; E04D 1/34; E04D 5/02; E04D 5/14; E04D 5/141; E04D 5/148; E04D 2001/005; E04D 2001/3408; E04D 2001/3435; E04D 2001/3438; E04D 2001/3444; E04D 2001/3447; E04D 2001/345; E04D 2001/3452; E04D 2001/3455; E04D 2001/3458; E04D 2001/347; E04D 2001/3482; E04D 2001/3485; E04D 2001/3491; E04D 1/00

USPC ..... 52/98, 99, 518, 519, 528, 532, 533, 52/535, 540, 543, 547, 314, 555, 557, 554, 52/559, DIG. 16, 415, 416, 419, 420

See application file for complete search history.

(56) References Cited

U.S. PATENT DOCUMENTS

| | | | | |
|---|---|---|---|---|
| 2,300,488 | A * | 11/1942 | Cuno | 52/420 |
| 5,239,802 | A * | 8/1993 | Robinson | 52/518 |
| 5,620,794 | A * | 4/1997 | Burkart et al. | 428/343 |
| 6,360,506 | B1 * | 3/2002 | Graae | 52/408 |
| 6,467,235 | B2 * | 10/2002 | Kalkanoglu et al. | 52/745.19 |
| 7,578,108 | B2 * | 8/2009 | Swanson | 52/540 |
| 2004/0107664 | A1 * | 6/2004 | Rodrigues | 52/557 |
| 2004/0172908 | A1 * | 9/2004 | Swann | 52/518 |
| 2005/0126103 | A1 * | 6/2005 | Scheirer et al. | 52/518 |
| 2007/0044410 | A1 * | 3/2007 | Kalkanoglu | 52/526 |
| 2007/0068109 | A1 * | 3/2007 | Swann | 52/518 |

* cited by examiner

*Primary Examiner* — Joshua J Michener
*Assistant Examiner* — Theodore Adamos
(74) *Attorney, Agent, or Firm* — Paul & Paul

(57) ABSTRACT

A weather resistant shingle system is provided, wherein a starter strip course of shingles is applied to a roof, and with successive courses of field shingles applied thereover, with adjacent underlying and overlying shingles adhesively secured together to provide wind resistance to tabs of next overlying shingles from being upwardly lifted under wind conditions, and to prevent moisture, such as rain, from entering beneath tabs of shingles.

16 Claims, 4 Drawing Sheets

WEATHER RESISTANT SHINGLE SYSTEM

CROSS-REFERENCE TO RELATED APPLICATION

This is a continuation of application Ser. No. 13/740,347 filed Jan. 14, 2013, which, in turn is a division of application Ser. No. 12/560,724, filed Sep. 16, 2009, now U.S. Pat. No. 8,365,493.

TECHNICAL FIELD OF INVENTION

This invention relates to shingles that are laid up on a roof in courses, such that tabs of field shingles in an overlying course cover butt portions of field shingles in a next-underlying course, and with such courses of shingles progressing up the slope of a roof, commencing with a first course of shingles which are starter strip shingles, with the starter strip shingles being covered by tab portions of field shingles in a first course of shingles.

BACKGROUND OF THE INVENTION

It is known in the shingle art to apply a starter strip course of shingles along the lower edge of a sloped roof, and then to cover that course with a first course of field shingles, with each field shingle having a lower tab portion that will often comprise a plurality of tabs, and with shingles in each course having butt or headlap portions. Successive courses of field shingles are applied, with the shingles in each course having their tab portions overlying butt portions of shingles in a next-underlying course.

It is also known to provide a wind-resistant feature comprised of adhesive between overlapping portions of shingles, to resist the upward lifting of shingles.

Examples of weather-resistant shingle systems are set forth in U.S. Pat. Nos. 5,239,802; 5,950,387 and 6,874,289, the complete disclosures of which are herein incorporated by reference.

SUMMARY OF INVENTION

The present invention is directed to a weather resistant shingle system of field shingles embodying butt portions and tab portions, that are laid up on a roof, in courses, such that adjacent underlying and overlying shingles have at least two adhesive connections therebetween for adhering overlapped shingles together, to resist tabs of shingles from being lifted upwardly by wind, and to provide separate moisture barriers to moisture penetration therebetween.

It is therefore an object of this invention to provide such shingles with at least two adhesive connections therebetween for resisting moisture penetration, and for resisting tabs of shingles from being lifted upwardly by wind.

It is a further object of this invention to accomplish the above object, with respect to overlying and underlying field shingles.

It is another object of this invention to accomplish the above objects with respect to starter shingles and overlying field shingles.

It is a further object of this invention to accomplish the above objects, using anywhere from three to six adhesive connections between underlying and overlying adjacent shingles, in different courses.

It is another object of this invention to accomplish the object immediately above, wherein there are adhesive connections of anywhere from two to six such connections between starter strip shingles and overlying field shingles of a first course of field shingles.

It is yet another object of this invention to accomplish the above objects, wherein the adhesive connections are either spaced apart at different distances from a bottom edge of overlying field shingles, or that are spaced apart at different distances between bottom edges of field shingles and underlying starter strip shingles, or wherein adhesive connections are in at least partial contact with each other, in full contact with each other, in nested contact with each other or in interlocked contact with each other.

Other objects and advantages of the present invention will be readily understood from a reading of the following brief descriptions of the drawing figures, the detailed descriptions of the preferred embodiments, and the appended claims.

BRIEF DESCRIPTION OF THE DRAWING FIGURES

Figure 1:
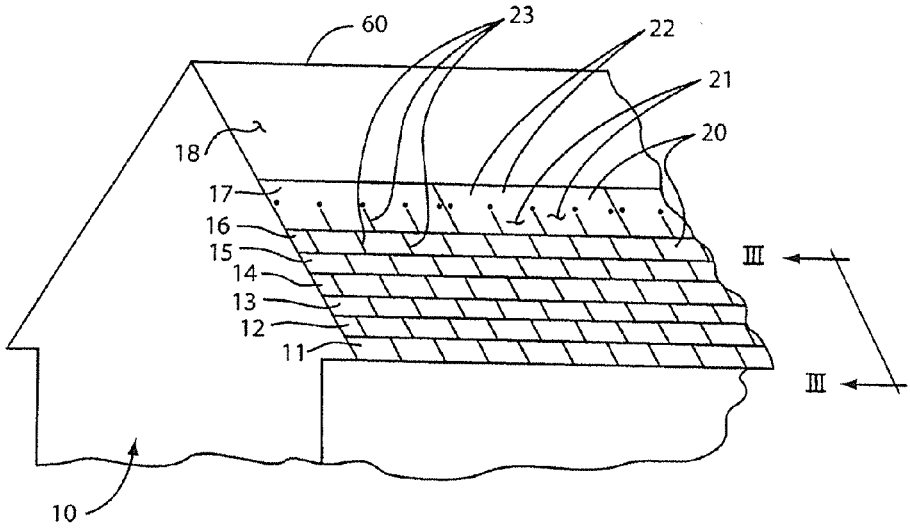
FIG. 1 is a top perspective view of a building roof having a plurality of courses of field shingles applied thereto, with tab portions of shingles in overlying courses covering butt portions of shingles in underlying courses.
Figure 2:
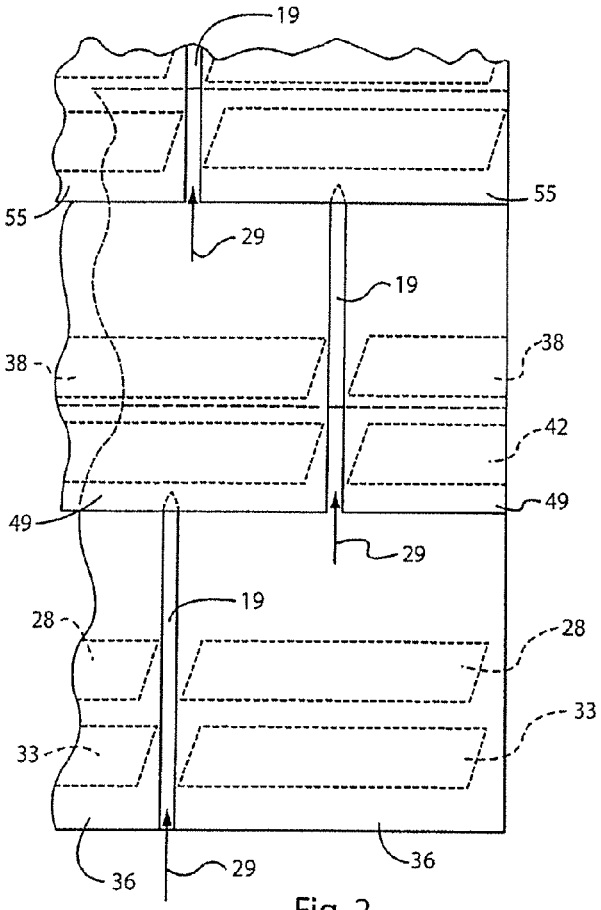
FIG. 2 is an enlarged fragmentary illustration of shingles in three successive courses, as they would appear when applied to a roof, with underlying adhesive connections being illustrated in broken lines.
Figure 3:
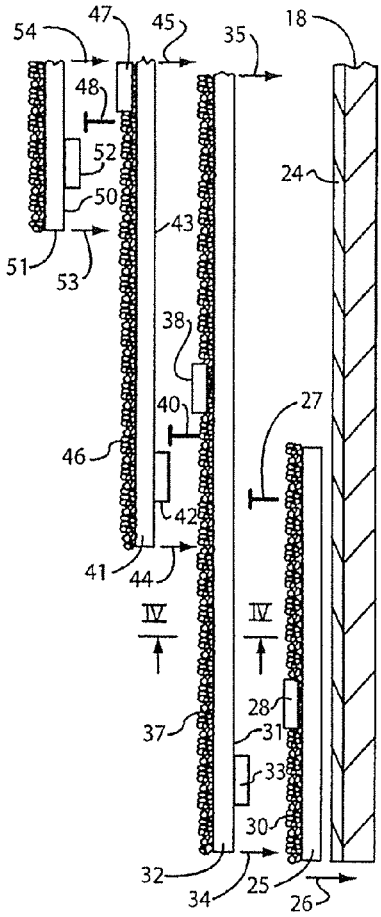

FIG. 3 is a right elevational view of a roof deck having a layer of underlining thereon, and with the three courses of shingles illustrated in FIG. 2 being shown in exploded view, but in relative positions as they would appear preparatory to being applied to the roof deck, with the illustration of FIG. 3 being taken generally along the line of FIG. 1, as well as from the right end of FIG. 2, showing the adhesive zones for connection that appear in broken lines in FIG. 2, in solid lines in FIG. 3.

Figure 4:
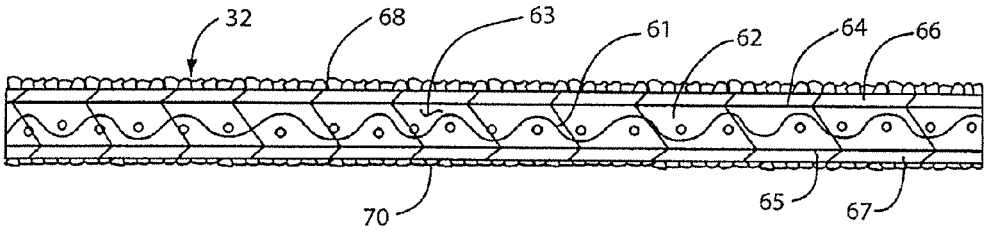

FIG. 4 is a an enlarged fragmentary cross-sectional view of a shingle of FIG. 3, taken generally along the line IV-IV of FIG. 3.

Figure 5:
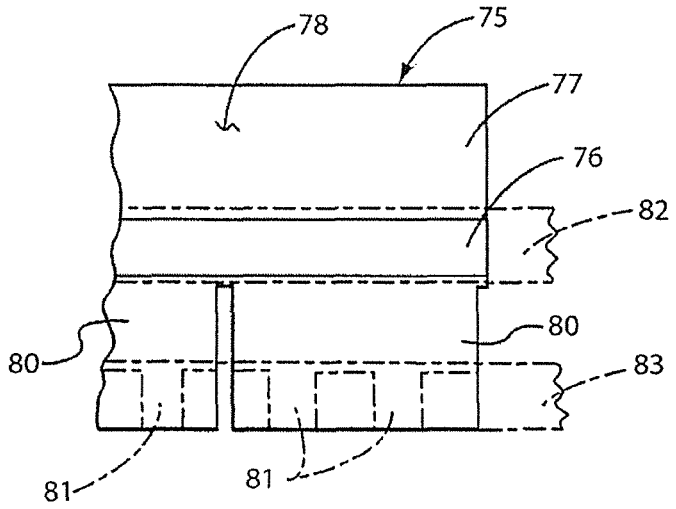

FIG. 5 is a fragmentary illustration of a shingle of this invention, wherein an alternate form of adhesive zones is illustrated, with adhesive zones at the lower ends of the tabs of the shingle of FIG. 5 being spaced apart, or discontinuous, and with the adhesive zone on the top surface of the shingle of FIG. 5 being continuous and in the butt portion of the shingle of FIG. 5, above the vertical slot, and with optional release tape being shown in phantom for each of the adhesive zones.

Figure 6:
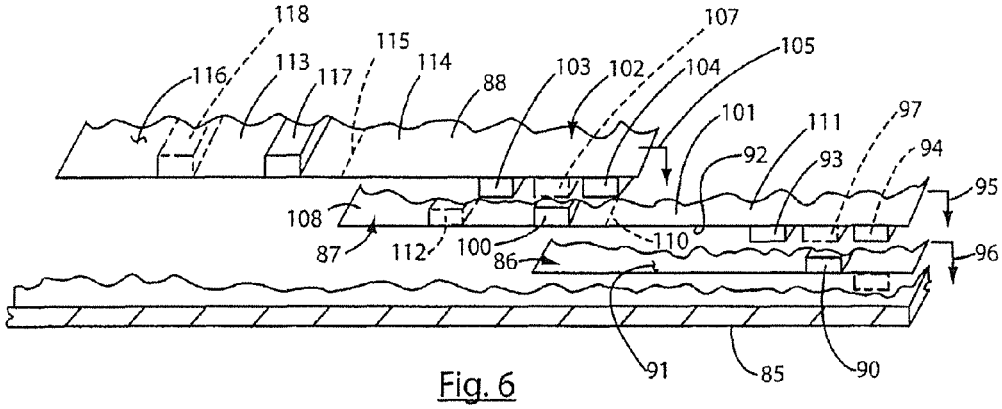

FIG. 6 is a fragmentary exploded view of a roof deck, having a starter strip shingle illustrated, along with two shingles of a first and a second course of shingles being fragmentally illustrated, with various zones of adhesive connection being also illustrated, either in full lines, or in phantom lines.

Figure 7:
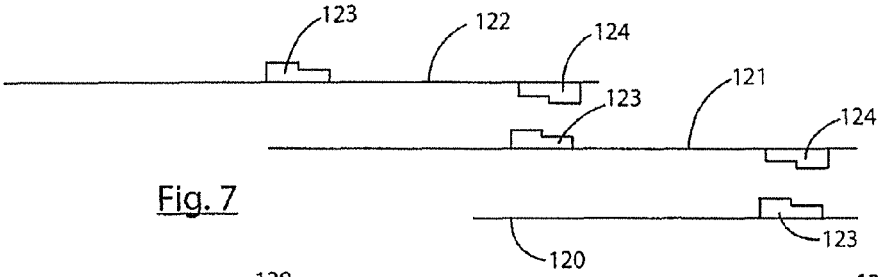

FIG. 7 is a schematic illustration of a starter strip shingle, with two field shingles about to be applied thereover, with the shingles of FIG. 7 being illustrated in end view, and in exploded form, and wherein adhesives on different surfaces of the shingles of FIG. 7 are illustrated in positions that would enable them to be in full contact with other adhesive connections, and with respect to the adhesive connections of FIG. 7, in interconnected manner.

FIGS. 8 through 13 are illustrations of various upper and lower adhesive connections for overlying and underlying shingles in partial or full or interconnected relation with each other, whereby various different embodiments of shingle adhesive connections are illustrated.

DETAILED DESCRIPTIONS OF THE PREFERRED EMBODIMENTS

Referring now to FIG. 1 in detail, a building 10 is illustrated with a plurality of courses 11-17 of shingles applied to a roof deck 18, with the shingles 20 in each course being applied with tab portions 21 of the shingles 20 being in overlying relation to butt portions 22 of adjacent next-underlying shingles, and with the shingles in a given course being laterally offset relative to shingles in a next-underlying course, so that slots 23 separating adjacent tabs in one course are not aligned with slots 23 of a next-underlying course of shingles.

Referring now to FIGS. 2 and 3, it will be seen that the roof deck 18 has a shingle underlayment 24 applied thereto. At the lower end of the roof deck 18 there is a course of starter strip shingles 25, illustrated in exploded view, preparatory to the starter strip shingles 25 being applied to the roof deck 18 upon movement in the direction of the arrow 26, and upon nails or other fasteners 27 being applied for fastening shingles 25 to the roof deck 18.

The shingles 25 each have a band of adhesive 28 thereon, as shown, carried on the upper surface 30 of each shingle 25 that faces a lower surface 31 of each shingle 32 in a first course of field shingles.

The shingles 32 have bands 33 of adhesive on their lower surfaces 31 such that, when each shingle 32 is moved rightwardly in the direction of the arrows 34, 35, the adhesive bands 28, 33 will adhesively engage respective shingle surfaces 31, 30, forming a double adhesive seal against shingles 32 in their course from being lifted upwardly by winds, thus providing a wind-resistant barrier to upward lifting, and also providing a double moisture barrier against rain entering between the shingles surfaces 30 and 31 beneath tabs 36.

The bands 28, 33 of adhesive are preferably continuous across their tabs 36, as shown in FIG. 2, although the same could be discontinuous, as may be desired.

The shingles 32 have, on their upper surfaces 37, adhesive bands 38, similar to the adhesive bands 28, and fasteners 40 of the nail or staple type will also be applied, as shown, to fasten the shingles 32 to the roof deck 18 when the shingles 32 are moved rightwardly, as shown, in the direction of the arrows 34, 35.

Shingles 41 in a second course of field shingles likewise have bands 42 of adhesive on their rear or lower surfaces 43 such that, when the shingles 41 in the second course of field shingles are moved rightwardly, in the direction of the arrows 44, 45, the adhesive bands 38, 42 will adhesively engage with respective shingle surfaces 43, 37, and nails or other fasteners 48 will likewise secure the shingles 41 to the roof deck 18, with tabs 49 of shingles 41 overlying butt portions of shingles 32 in the next-underlying course.

The shingles 41 have, on their upper surfaces 46, bands 47 of adhesive to be secured against lower surfaces 50 of shingles 51 in a next-overlying course of field shingles. Shingles 51 have on their rear surfaces 50, bands 52 of adhesive. The bands 47, 52 of adhesive will respectively adhesively engage shingle surfaces 50, 46, upon rightward movement of shingles 51 in the direction of the arrows 53, 54, likewise forming a double barrier against upward lifting of shingles 51 under wind forces, and likewise form a double moisture barrier, against rain entering beneath tabs 55 of shingles 51. At the locations of slots 19 between adjacent tabs 36, 49, 55 of shingles, moisture from rain, snow or the like passing upwardly in the directions of arrows 29 meets the barriers formed by adhesive zones beneath next-overlying shingles, above the slots 19.

With reference to FIGS. 2 and 3, for example, it will be seen that, with respect to the pairs of bands of adhesive 28, 33; 38, 42 and 47, 52, in which the bands 28, 38 and 47 are disposed higher than the bands 33, 42 and 52, it will be apparent that, as an alternative arrangement, the bands 33, 42 and 52 could be at higher locations relative to the shingles 32, 41 and 51, with the bands 28, 38 and 47 being at lower locations on their respective shingles 25, 32 and 41, below the vertical placements of the bands 33, 42 and 52, if desired.

The above shingling process will thus continue, upwardly, to the apex 60 of the roof of the building of FIG. 1, with next overlying and next underlying shingles having double adhesive connections securing tab portions of next-overlying shingles to butt portions of next underlying shingles.

Referring to FIG. 4, it will be seen that each shingle described above is preferably comprised of a web 61 of organic or preferably inorganic material, such as fiberglass, that is impregnated with a bitumen material 62, such as asphalt, to yield an asphalt-impregnated web 63. Upper and lower surfaces 64, 65 of the asphalt impregnated web 63 have respective adhesive layers 66, 67 applied thereto, which adhesive layers 66, 67 can likewise be a bituminous material such as asphalt, and the outward facing surfaces of the adhesive layers 66, 67 have a respective granule layer 68 and smaller particle layer 70 applied thereto. The smaller particles can, if desired, be sand, mica or the like. The granules 68, applied to the upper or outer surfaces of the shingle 32 can be comprised of ground slate, gravel, or any other substance that is desired, which will protect the underlying bituminous material from heat of the sun, ultraviolet rays, and the like.

With reference to FIG. 5, it will be seen that a shingle 75 is fragmentally illustrated, having an adhesive band 76 in its butt or headlap shingle portion 77, applied on the upper surface 78 of the shingle 75. At the lower end of the rear surface (unnumbered) of each tab portion 80 of the shingle 75, there are provided a band of discontinuous zones of adhesive 81, and the bands of adhesive 76, 81 can, if desired, have removable release tapes 82, 83, protecting the adhesive bands from becoming adhered to next overlying or next-underlying shingles in a stack, during storage and/or shipment of stacks of shingles. Alternatively, the release strips 82, 83, could be applied to next-adjacent shingles in the stacks, such that when a plurality of shingles are stacked together, adhesive surfaces of one shingle would engage against release tape surfaces of an adjacent underlying or overlying shingle in the stack, such that when release tapes are carried by adjacent underlying or overlying shingles rather than being applied directly to the adhesive portions of a given shingle, such release tapes may, if desired, be permanently carried by the underlying or overlying shingles.

In FIG. 6 there are fragmentally shown a roof deck 85, a starter strip shingle 86, a field shingle 87 in a first course of field shingles, and a field shingle 88 of a second course of field shingles, all in exploded view. The starter strip shingle 86 is provided with an adhesive band 90 shown in full lines, on the upper surface 91 of the shingle 86. The shingle 87 has, on its lower surface 92, bands 93 and 94 of adhesive, spaced apart from each other, such that when the shingle 87 is brought into engagement with the starter strip shingle 86, upon movement of the shingles toward the roof deck 85 in the direction of the arrows 95, 96, the adhesive band 90 will engage against the lower surface 92 of the shingle 87, and the adhesive bands 93, 94 carried on the lower surface 92 of the shingle 87 will engage against the upper surface 91 of the starter strip shingle 86, thereby forming three spaced-apart bands of adhesive for protecting the shingle 86 from being lifted upwardly by wind, and for preventing moisture such as rain, from entering between the shingles 86, 87, from the right end thereof.

Optionally, an additional adhesive band 97 may be carried by the lower surface 92 of the shingle 87, as is shown in phantom in FIG. 6, such that the optional adhesive band 97 could engage with the adhesive band 90 carried on surface 91 of the shingle 86.

The shingle 87 has an adhesive band 100 carried on its upper surface 101, and the shingle 102 carries bands 103, 104 of adhesive to engage against upper surface 101 of the shingle 87 upon movement of the shingle 88 in the direction of arrow 105, as the shingle 88 is brought into contact against the shingle 87, such that the bands 100, 103 and 104 will secure the shingles 88 and 87 against each other, as has been described above with respect to the adhesive bands 90, 93 and 94 securing the shingles 87 and 86 against each other.

The shingle 88 is also shown to have an optional additional band 107 of adhesive for engagement against the band 100 when the shingles 88, 87 are brought together, in a manner similar to the engagement of the bands 97, 90 of adhesive to each other when the shingles 87 and 86 are brought together. It will be noted that the band 100 of adhesive for shingle 87 is located in the butt portion 108 of shingle 87, which is above the imaginary line 110 separating the butt portion 108 from the tab portion 111 of shingle 87.

Optionally, an additional band 112 of adhesive, shown in phantom on the upper surface 101 of the shingle 87, may be provided to form an additional barrier against moisture entry, and to form an additional barrier against wind uplifting of the shingle 88.

The shingle 88 likewise has respective butt and tab portions 113, 114, respectively, separated by an imaginary line 115, and will have on its upper surface 116, an adhesive band 117, similar to the adhesive band 100 for shingle 87. Also, as with the shingle 87, the shingle 88 may optionally have an additional band 118 of adhesive (shown in phantom) similar to the band 112 of adhesive for the shingle 87.

In FIG. 7, there are schematically shown a starter strip shingle 120, a field shingle 121 of a first course, and a field shingle 122 of a second course of shingles, shown in exploded view preparatory to those shingles being brought together and applied to a roof deck. The shingles 120-122 are provided with bands of adhesive 123, 124, that are constructed to be of shapes that enable them to be nested or interlocked with each other, as shown, when those bands 123, 124 of adhesive are brought into contact with each other, as the shingles 120, 121 and 122 are brought together.

Figure 8:
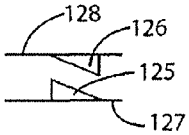

In FIG. 8 an alternative configuration is provided in the form of triangular configurations of adhesive bands 125, 126, carried on respective shingles 127, 128 (fragmentally illustrated), such that the adhesive bands 125, 126 would be brought into full contact with each other as their sloped surfaces engage with each other.

Figure 9:
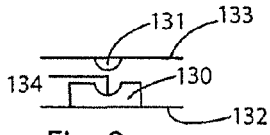

In FIG. 9, yet another configuration is provided for bands 130, 131 of adhesive, carried by fragmentally illustrated shingle portions 132, 133, such that the band 131 of adhesive can nest within the recess 134 of adhesive band 130 when the shingles 132, 133, are brought together, also in interlocked, nested relation.

Figure 10:
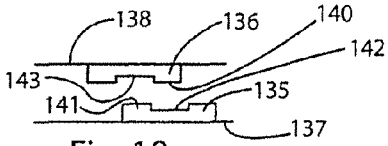

In FIG. 10, yet another configuration is provided for bands 135, 136 of adhesive respectively carried by shingles 137, 138, also fragmentally illustrated, whereby an additional interlocked, nesting configuration is provided whereby downwardly facing legs 140 of adhesive 136 and upwardly facing legs 141 of respective adhesive bands 136, 135 can nest within respective recesses 142, 143 of bands 135, 136 of adhesive, when the shingles 137, 138 are brought together.

Figure 11:
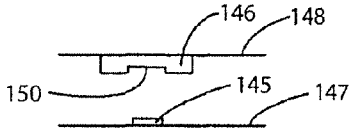

In FIG. 11, yet another interlocked, nesting arrangement is shown whereby bands 145, 146 of adhesive carried by respective shingles 147, 148 can be interlocked, by means of the band 145 being disposed within recess 150 of band 146, when the shingles 147, 148 are brought together.

Figure 12:
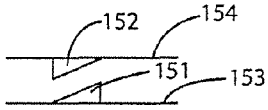

In FIG. 12, bands 151 and 152 of adhesive carried by respective shingles 153, 154 are illustrated, in full overlap, with the bands 151, 152 being illustrated as being triangular in cross-section, in a manner opposite to the triangular configurations illustrated in FIG. 8.

Figure 13:
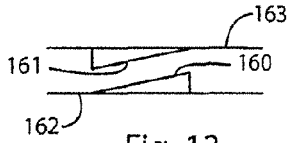

In FIG. 13, there are illustrated bands 160, 161 of adhesive carried by respective shingles 162, 163, in a manner similar to those illustrated in FIG. 12, but wherein the bands 160, 161 are offset relative to each other, as shown, to be in partial contact with each other when the shingles 162, 163 are brought together in adhesive securement.

With respect to the bands of adhesive of the type illustrated in FIG. 3, where the bands, in pairs 28, 33; 38, 40 and 47, 52 may not actually be in engagement with each other, and most especially with the bands that are in engagement with each other, when the shingle layers are brought together, as for example in FIGS. 6, 7, and any of 8-13, it will be apparent that the different bands that either are or are not in engagement with each other may have the same adhesive properties, or they could have different adhesive properties. For example, opposing bands that are to be in engagement with each other, such as are shown in FIGS. 6-13, could have one of the bands of one formation, and another of a different formation. That is, one of the bands could be more tacky and the other band with which it is to be in engagement could be stiffer. Either of the bands could be of a modified asphalt formulation, or of different compositions, as may render opposing bands that are to be in engagement with each other to more effectively adhere together.

While the particular embodiments of the shingles that are shown in the drawings are shingles with slots separating the tabs, it will be apparent that, within the scope of this invention, this invention applies equally well to shingles having a greater or fewer number of slots, as well as with shingles having no slots in the tab areas. Furthermore, the present invention applies to laminated shingles having a rear layer that is either of approximately half height (covering the rear surfaces of the tab portions of the shingles), and/or laminated shingles that have the rear layers of full height (that is, covering the rear surfaces of the tab portions of the shingles, as well as the rear surfaces of the butt or headlap portions of the shingles. The present invention is therefore applicable to various other types of shingles, for example, as are set forth in U.S. Pat. Nos. 6,205,734; 6,467,235; 6,523,316 and 6,920,730, the complete disclosures of which are herein incorporated by reference.

It will be apparent from the foregoing that various modifications may be made in the adhesive connections between adjacent shingles as they are brought together, all within the spirit and scope of the invention as defined in the appended claims.

What is claimed is:

1. A system of a plurality of courses of field shingles, each field shingle comprising:

(a) a butt portion and a tab portion and comprising a bitumen impregnated web having upper and lower surfaces with granules adhesively secured on at least said tab portion of the upper surface and with particles adhesively secured on the lower surface, wherein the tab portion comprises a plurality of spaced-apart tabs of tab width, separated by slots;

(b) with each field shingle having a top edge and a bottom edge and having at least first and second lines of adhesive generally parallel to one of said top and bottom edges, with the first line of adhesive being carried on a surface of the butt portion of the shingle and with the second line of adhesive being carried on a surface of the tab portion of said shingle;

(c) with the at least first and second lines of adhesive, when a plurality of field shingles are laid up on a roof in courses with tab portions of shingles in an overlying course overlying butt portions of shingles in a next-underlying course, the first line of adhesive on an underlying shingle course being in an engagement with said second line of adhesive of an overlying shingle; with said engaged lines of adhesive each being of a three-dimensional configuration and being in any one of:

(i) nested;

(ii) interlocked; and (iii) of sloped surface;

relation with each other and comprising a moisture barrier against moisture penetrating between underlying and overlying field shingles in adjacent courses; wherein said engaged first and second lines of adhesive are any one of:

(iv) each having a thicker portion and a thinner portion, with the thinner portion of the first and second lines of adhesive being in engagement with a thicker portion of the other of the first and second lines of adhesive;

(v) each of triangular vertical cross-section, having sloped surfaces, with the sloped surfaces of the first and second lines of adhesive being in surface-to-surface engagement with each other; and (vi) one having a projection and the other of the first and second lines of adhesive having a recess; with the projection of a line of adhesive being in nested engagement with a recess of a different line of adhesive.

2. The system of claim 1, wherein said engaged lines of adhesive form a wind resistant barrier against wind lifting an overlying field shingle from adjacent engagement with a next-underlying shingle.

3. The system of claim 1, wherein said engaged lines of adhesive are continuous across said shingle between right and left ends of tabs.

4. The system of claim 1, wherein one of the first and second lines of adhesive is of a formulation that renders it more tacky than another of the first and second lines of adhesive and said another of the first and second lines of adhesive is of a formulation that makes it stiffer than said one of the first and second lines of adhesive and thereby less tacky.

5. The system of claim 1, wherein at least one of said first and second lines of adhesive is provided with a removable release strip covering said line of adhesive.

6. The system of claim 1, wherein each of the projection and recess of clause (vi) are of generally arcuate cross-section.

7. The system of claim 1, wherein each of the projection and recess of clause (vi) are of generally rectangular cross-section.

8. The system of claim 1, wherein the first and second lines of adhesive are partially vertically offset relative to each other.

9. A system of a plurality of courses of field shingles, each field shingle comprising:

(a) a butt portion and a tab portion and comprising a bitumen impregnated web having upper and lower surfaces with granules adhesively secured on at least said tab portion of the upper surface and with particles adhesively secured on the lower surface, wherein the tab portion comprises a plurality of spaced-apart tabs of tab width, separated by slots;

(b) with each field shingle having a top edge and a bottom edge and having at least first and second lines of adhesive generally parallel to one of said top and bottom edges, with the first line of adhesive being carried on a surface of the butt portion of the shingle and with the second line of adhesive being carried on a surface of the tab portion of said shingle;

(c) with the at least first and second lines of adhesive, when a plurality of field shingles are laid up on a roof in courses with tab portions of shingles in an overlying course overlying butt portions of shingles in a next-underlying course, the first line of adhesive on an underlying shingle course being in an engagement with said second line of adhesive of an overlying shingle; with said engaged lines of adhesive each being of a three-dimensional configuration and being in any one of:

(i) nested;

(ii) interlocked; and (iii) of sloped surface;

relation with each other and comprising a moisture barrier against moisture penetrating between underlying and overlying field shingles in adjacent courses; wherein said engaged first and second lines of adhesive are any one of:

(iv) each having a thicker portion and a thinner portion, with the thinner portion of the first and second lines of adhesive being in engagement with a thicker portion of the other of the first and second lines of adhesive;

(v) each of triangular vertical cross-section, having sloped surfaces, with the sloped surfaces of the first and second lines of adhesive being in surface-to-surface engagement with each other; and (vi) one having a projection and the other of the first and second lines of adhesive having a recess; with the projection of a line of adhesive being in nested engagement with a recess of a different line of adhesive, wherein one of the first and second lines of adhesive is of a formulation that renders it stiffer than another of the first and second lines of adhesive.

10. The system of claim 9, wherein said engaged lines of adhesive form a wind resistant barrier against wind lifting an overlying field shingle from adjacent engagement with a next-underlying shingle.

11. The system of claim 9, wherein said engaged lines of adhesive are continuous across said shingle between right and left ends of tabs.

12. The system of claim 9, wherein said another of the first and second lines of adhesive is of a formulation that makes it more tacky than said one of the first and second lines of adhesive.

13. The system of claim 9, wherein at least one of said first and second lines of adhesive is provided with a removable release strip covering said line of adhesive.

14. The system of claim 9, wherein each of the projection and recess of clause (vi) are of generally arcuate cross-section.

15. The system of claim 9, wherein each of the projection and recess of clause (vi) are of generally rectangular cross-section.

16. The system of claim 9, wherein the first and second lines of adhesive are partially vertically offset relative to each other.

* * * * *

UNITED STATES PATENT AND TRADEMARK OFFICE

CERTIFICATE OF CORRECTION

PATENT NO. : 9,157,236 B2
APPLICATION NO. : 14/302781
DATED : October 13, 2015
INVENTOR(S) : Robert L. Jenkins It is certified that error appears in the above-identified patent and that said Letters Patent is hereby corrected as shown below:

In the Specification

Column 2, Line 34, after "line" insert -- III-III --

Signed and Sealed this
Fourteenth Day of June, 2016

Michelle K. Lee

Michelle K. Lee
*Director of the United States Patent and Trademark Office*